US008119953B2

(12) United States Patent
Worden et al.

(10) Patent No.: US 8,119,953 B2
(45) Date of Patent: Feb. 21, 2012

(54) HEATING CONTROL SYSTEM USING A FLUID LEVEL SENSOR AND A HEATING CONTROL ELEMENT

(75) Inventors: Daniel John Worden, Mason City, IA (US); Karl James Bauer, Garner, IA (US)

(73) Assignee: Oshkosh Truck Corporation, Oshkosh, WI (US)

( * ) Notice: Subject to any disclaimer, the term of this patent is extended or adjusted under 35 U.S.C. 154(b) by 1089 days.

(21) Appl. No.: 11/982,012

(22) Filed: Nov. 1, 2007

(65) Prior Publication Data

US 2009/0114734 A1 May 7, 2009

(51) Int. Cl.
*H05B 1/02* (2006.01)

(52) U.S. Cl. ..... 219/497; 219/508; 219/519; 392/449

(58) Field of Classification Search ..... 219/497, 219/492, 507–509, 482, 481; 392/444, 449
See application file for complete search history.

(56) References Cited

U.S. PATENT DOCUMENTS

| | | | | |
|---|---|---|---|---|
| 3,826,895 | A | 7/1974 | Schladitz | |
| 5,524,527 | A | 6/1996 | Dumoux et al. | |
| 6,101,984 | A | 8/2000 | Nir | |
| 6,318,599 | B2 | 11/2001 | Estelle et al. | |
| 6,872,923 | B2 * | 3/2005 | Cretors et al. | 219/494 |
| 7,234,389 | B1 * | 6/2007 | Lassota | 99/282 |
| 7,278,587 | B2 | 10/2007 | Ohminami | |
| 2007/0204857 | A1 * | 9/2007 | Reusche et al. | 126/374.1 |

FOREIGN PATENT DOCUMENTS

WO WO 03/050454 A2 6/2003

* cited by examiner

*Primary Examiner* — Mark Paschall
(74) *Attorney, Agent, or Firm* — Foley & Lardner LLP

(57) ABSTRACT

A heating control system for controlling heating of a fluid contained in a fluid vessel using a fluid level sensor as a heating control element. The system includes a control circuit coupled with an electrical power system of a heating unit. The control circuit includes switching elements that are selectively activated or deactivated responsive to a low fluid level in a corresponding fluid vessel such that heating of the fluid is terminated as the level of fluid becomes less than a predetermined value.

20 Claims, 3 Drawing Sheets

HEATING CONTROL SYSTEM USING A FLUID LEVEL SENSOR AND A HEATING CONTROL ELEMENT

FIELD

A heating control system for controlling heating of fluids contained in fluid vessels. More particularly, it is directed to a heating control system which provides improved heating control by utilizing a temperature sensor as a heating control. It is also directed to a heating control system that can be used in various mobile applications, such as portable fluid delivery systems.

BACKGROUND

Heating control systems for controlling heating of a fluid, such as various vehicle servicing fluids, water, and the like, contained in a fluid vessel typically include a temperature sensor with a periodic on/off duty cycle determined by the deviation of the sensed temperature from a predetermined set point. The temperature sensor is coupled with a control circuitry for applying power to the heating elements. The control circuitry in previous heating control systems of the type, is typically complex. In addition, the temperature in different parts of the fluid vessel varies significantly and often does not correspond to the temperature indicated by the temperature sensor. The latter becomes especially important as the level of the fluid in the fluid vessel gets low leading to overheating of the fluid and damaging the heating elements. Furthermore, previous heating control systems do not employ visual monitoring of the level of the fluid in the fluid vessel.

Thus, there is a need for a heating control system for controlling heating of a fluid contained in a fluid vessel with a less complicated control circuitry that is more convenient for a user.

A need also exists for a heating control system that protects the fluid from being overheated.

There also exists a need for a heating control system that protects the heating elements from damage.

Furthermore, a need also exists for a heating control system that employs visual monitoring of the level of the fluid in a fluid vessel.

SUMMARY

There is provided a heating control system for controlling heating of fluids contained in fluid vessels with a less complicated control circuitry. There is provided a heating control system that protects the fluid from being overheated, and protects the heating elements from damage.

There is also provided a heating control system that can be used in various mobile applications, such as portable fluid delivery systems and employs visual monitoring of the level of the fluids in the fluid vessels.

Further, there is provided a heating control system for controlling heating of a fluid included in a fluid vessel including at least one electrical power input and at least one electrical power on/off switch. The at least one electrical power on/off switch is in electrical communication with the at least one electrical power input. The heating control system includes at least one sensor responsive to a low fluid level in an associated corresponding fluid vessel. The at least one sensor responsive to a low fluid level is coupled with a fluid included in an associated corresponding fluid vessel. Also included in the heating control system is at least one first and at least one second switch. The at least one first switch is in electrical communication with the at least one electrical power on/off switch. The at least one first switch is configured for being responsive to a predetermined condition status of the at least one sensor responsive to a low fluid level in an associated corresponding fluid vessel. The at least one second switch is in electrical communication with the at least one first switch, and is configured for being responsive to a predetermined condition status of the at least one first switch for selectively activating an electrical power system of a corresponding heating unit.

In one embodiment, the at least one sensor responsive to a low fluid level in an associated corresponding fluid vessel further comprises sensor and indicator. The sensor is coupled with a fluid contained within a corresponding fluid vessel and is configured for sensing a low fluid level in an associated corresponding fluid vessel. The indicator is configured for indicating a low fluid level in an associated corresponding fluid vessel.

In another embodiment, the heating control system further includes at least one medium fluid sensor responsive to a medium fluid level in the fluid vessel, and at least one high fluid sensor responsive to a high fluid level in the fluid vessel. Each fluid sensor includes an indicator. Each sensor is coupled with a fluid contained within an associated corresponding fluid vessel and is configured for sensing a corresponding fluid level in an associated corresponding fluid vessel. Each associated sensor is configured for indicating a corresponding fluid level in an associated corresponding fluid vessel.

The heating control system, preferably, includes a control panel, wherein an indicator of the respective sensor is responsive to a low fluid level, responsive to a medium fluid level, and responsive to a high fluid level in a corresponding fluid vessel, are placed on the control panel. The at least one electrical power input is, preferably, a DC electrical power source. The electrical power system of a corresponding heating unit is, preferably, an AC electrical power system.

Further, there is provided a heating control system for controlling heating of a fluid contained in a fluid vessel including a control circuit and a low fluid level sensor coupled with the fluid contained within an associated fluid vessel. The control circuit is coupled with an electrical power system of a heating unit. The control circuit includes an electrical power source input port and an electrical power on/off switch electrically connected with the electrical power source input port. The control circuit also includes a first relay and a second relay. The first relay includes an input coil, a first transfer output contact, a second transfer output contact, and a common terminal. The input coil of the first relay is selectively electrically connected with the electrical power on/off switch responsive to a predetermined condition status of the low fluid level sensor. The common terminal of the first relay is electrically connected to the electrical power on/off switch. The second relay includes an input coil electrically connected with the first transfer output contact of the first relay. The second relay also includes normally open output contacts electrically connected with an electrical power system of a heating unit.

In a preferred embodiment, the low fluid level sensor is further coupled with a first portion of the control circuit. The first portion of the control circuit is configured for selectively establishing an electrical connection of the input coil of the first relay with the electrical power on/off switch responsive to a predetermined condition status of the low fluid level sensor.

In another preferred embodiment the heating control system further includes a low fluid level indicator and a flasher relay. The flasher relay is configured for initializing flashing of the low fluid level indicator responsive to a predetermined condition status of the first relay. The low fluid level indicator is electrically connected with the second transfer output contact of the first relay through the flasher relay.

In another preferred embodiment, the heating control system further includes a high fluid level sensor, and a high fluid level indicator. The high fluid level sensor is coupled with a second portion of the control circuit. The second portion of the control circuit is adapted for selectively establishing an electrical connection of the high fluid level indicator with the electrical power on/off switch responsive to a predetermined condition status of the high fluid level sensor. Preferably, the heating control system further includes a medium fluid level sensor, and a medium fluid level indicator. The medium fluid level sensor is coupled with a third portion of the control circuit. The third portion of the control circuit is adapted for selectively establishing an electrical connection of the medium fluid level indicator with the electrical power on/off switch responsive to a predetermined condition status of the medium fluid level sensor.

In yet another preferred embodiment, the heating control system further includes a control panel. The electrical power on/off switch, the low fluid level indicator, the medium fluid level indicator and the high fluid level indicator are placed on the control panel. Preferably, the heating control system further includes a push button switch. The push button switch is adapted for selectively establishing an electrical connection between the electrical power source input port and at least one of the following: the low fluid level indicator, the medium fluid level indicator, and the high fluid level indicator. The push button switch is suitably also placed on the control panel. The heating control system, preferably, further includes a heat indicator, which is in electrical communication with the input coil of the second relay, the heat indicator is also suitably placed on the control panel. In a preferred embodiment the heat indicator is combined with the electrical power on/off switch.

In a preferred embodiment, the electrical power source input port of the heating control system is an input port of a DC electrical power source. The electrical power system of a heating unit is, preferably, an AC electrical power system. The electrical power on/off switch is, preferably, of a manual type.

In an alternative embodiment the heating control system further includes a temperature sensor adapted for selectively terminating heating of a fluid contained in the fluid vessel, wherein the temperature sensor is coupled with the fluid contained within the fluid vessel. Preferably, the temperature sensor is coupled with a fourth portion of the control circuit. The fourth portion of the control circuit is configured to selectively disrupt an electrical connection of the input coil of the second relay with the first transfer output contact of the first relay, responsive to a predetermined condition status of the temperature sensor.

Still other objects and aspects of the heating control system will become readily apparent to those skilled in this art from the following description, simply by way of illustration of one of the best modes. As it will be realized by those skilled in the art, the exemplary embodiment of a heating control system is capable of other different embodiments and its several details are capable of modifications in various obvious aspects. Accordingly, the drawings and descriptions will be regarded as illustrative in nature and not as restrictive.

DETAILED DESCRIPTION OF THE EXEMPLARY EMBODIMENTS

Figure 1:
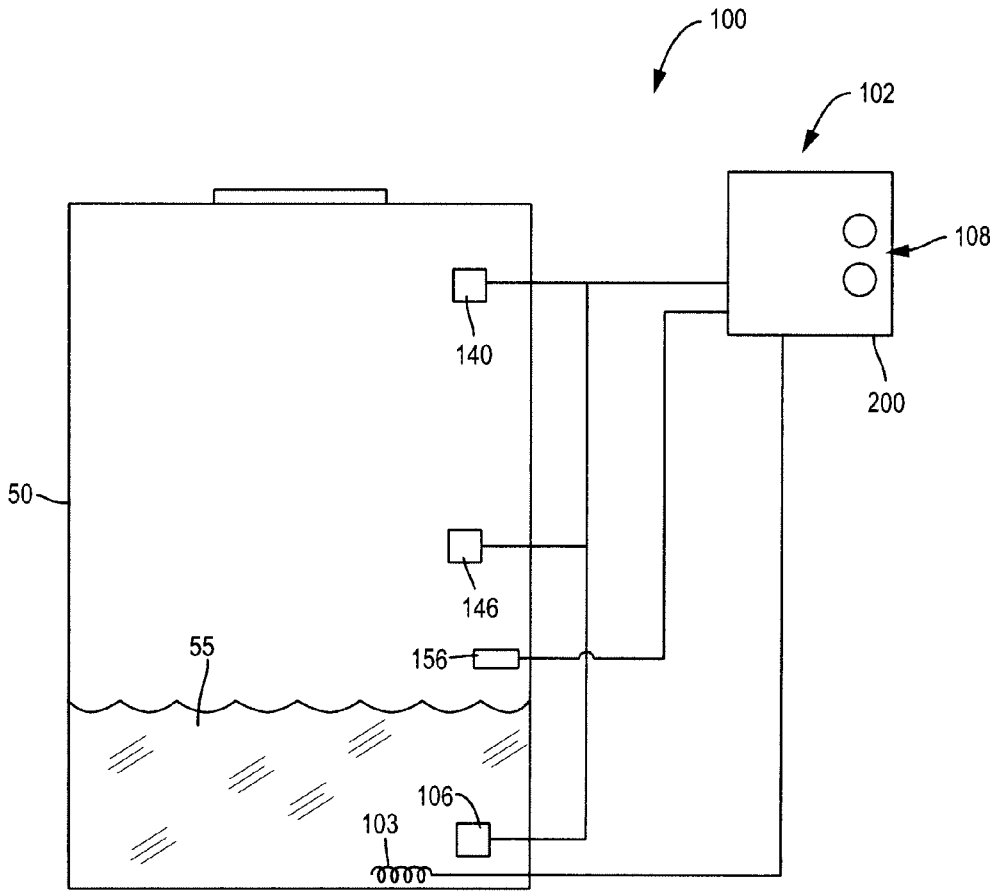
FIG. 1 is a schematic illustration of an exemplary embodiment of a heating control system coupled to a fluid vessel containing fluid.

There is provided a heating control system for controlling heating of a fluid 55 contained in a fluid vessel 50 (See FIG. 1). In particular, a heating control system 100 which provides improved heating control by utilizing a low fluid level sensor 106 as a heating control element. The heating control system 100 provides protection from overheating fluids contained in fluid vessels, provides protection from damaging heating elements, and employs visual monitoring of the level of a fluid in the fluid vessel. The control circuitry of the present invention is less complicated than in previous systems and more convenient for a user.

Figure 2:
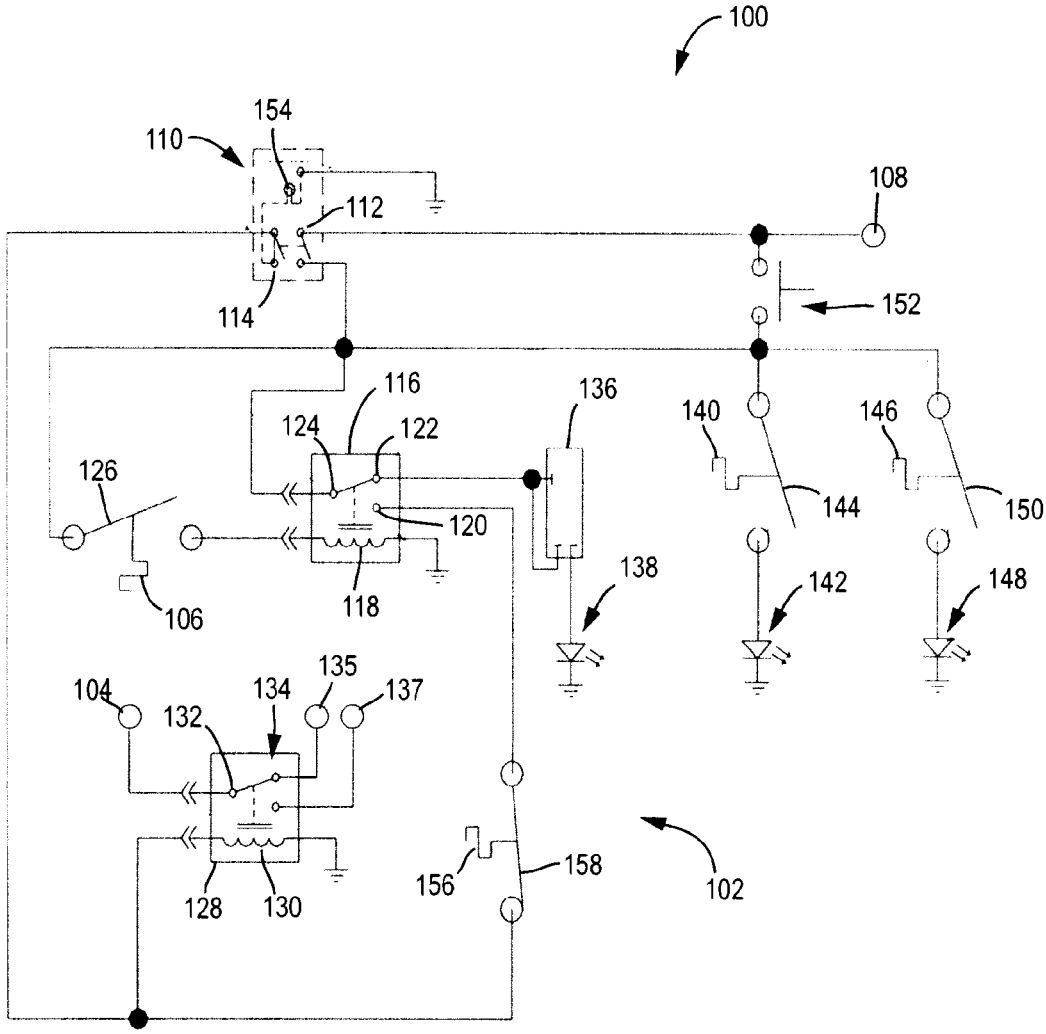
FIG. 2 is a circuit diagram of an exemplary embodiment of a heating control system.

Turning now to FIG. 2, there is shown an exemplary circuit diagram of the heating control system 100 for controlling heating of a fluid contained in a fluid vessel in accordance with the present invention. As shown in FIG. 2, the system 100 includes a control circuit 102 coupled with port terminals of an electrical power system 104 of a heating unit 103. The electrical power system of a heating unit is suitably, but not limited to, an AC electrical power system. The system 100 includes a sensor responsive to a low fluid level in the fluid vessel coupled with the fluid 55 contained within the fluid vessel 50. The sensor responsive to a low fluid level in the fluid vessel is represented as a low fluid level sensor 106. The low fluid level sensor 106 is capable of being implemented as any fluid level sensor known in the art, for example, and without limitation, as a float-type sensor. The control circuit 102 suitably includes an electrical power input represented as an electrical power source input port 108, which is preferably, an input port of a DC electrical power source. In a preferred embodiment, a standard 12V DC electrical power source is used. However, a skilled artisan will recognize that the control circuit 102 is capable of using DC electrical power sources of other voltage, as well as AC electrical power sources. The control circuit 102 also includes an electrical power on/off switch represented as an electrical power on/off switch 110, which is electrically connected with the electrical power source input port 108. The switch 110 is capable of being implemented by any on/off switch known in the art. In the embodiment illustrated in FIG. 2, the switch 110 includes a pair of normally open contacts 112, 114.

The control circuit 102 further includes first switching device represented as a first relay 116. The first relay 116 includes an input coil 118, a first transfer output contact 120, a second transfer output contact 122, and a common terminal 124. The common terminal 124 of the first relay 116 is electrically connected with the electrical power on/off switch 110. The input coil 118 of the first relay 116 is selectively electrically connected with the electrical power on/off switch 110 responsive to a predetermined condition status of the low fluid level sensor 106. The low fluid level sensor 106 serves as a heating control element and is coupled with a first portion 126 of the control circuit 102. The first portion 126 of the control circuit 102 is configured to selectively establish an electrical connection of the input coil 118 of the first relay 116 with the electrical power on/off switch 110 responsive to a predetermined condition status of the low fluid level sensor 106, as will be explained in detail below.

The control circuit 102 further includes second switching device represented as a second relay 128. The second relay 128 includes an input coil 130 electrically connected with the first transfer output contact 120 of the first relay 116, and normally open output contacts 132, 134 electrically connected with the electrical power system 104 of a heating unit. Input to the relay 128 can be from shop power input 135 or motor generator power input 137 as determined by an operator. A motor generator unit (not shown) typically is mounted on a vehicle, for example, a truck or trailer.

In the embodiment illustrated in FIG. 2, a flasher relay 136 is connected with the second transfer output contact 122 of the first relay 116. A low fluid level indicator 138 is connected with the second transfer output contact 122 of the first relay 116 through the flasher relay 136. The first relay 116, the second relay 128, and the flasher relay 136 are suitably implemented in suitable construction and employ suitable characteristics as known in the art, to meet the application guidelines as depicted herein.

In the preferred embodiment depicted in FIG. 2, control circuit 102 includes a high fluid level sensor 140, and a high fluid level indicator 142. The high fluid level sensor 140 is coupled with a second portion 144 of the control circuit 102. The second portion 144 of the control circuit 102 is configured for selectively establishing an electrical connection of the high fluid level indicator 142 with the electrical power on/off switch 110 responsive to a predetermined condition status of the high fluid level sensor 140. The embodiment of FIG. 2 also includes a medium fluid level sensor 146, and a medium fluid level indicator 148. The medium fluid level sensor 146 is coupled with a third portion 150 of the control circuit 102. The third portion 150 of the control circuit 102 is suitably configured for selectively establishing an electrical connection of the medium fluid level indicator 148 with the electrical power on/off switch 110 responsive to a predetermined condition status of the medium fluid level sensor 146, as will be described in detail below. The fluid level indicators 138, 142 and 148 are implemented, for example, and without limitation, as light emitting diodes.

Figure 3:
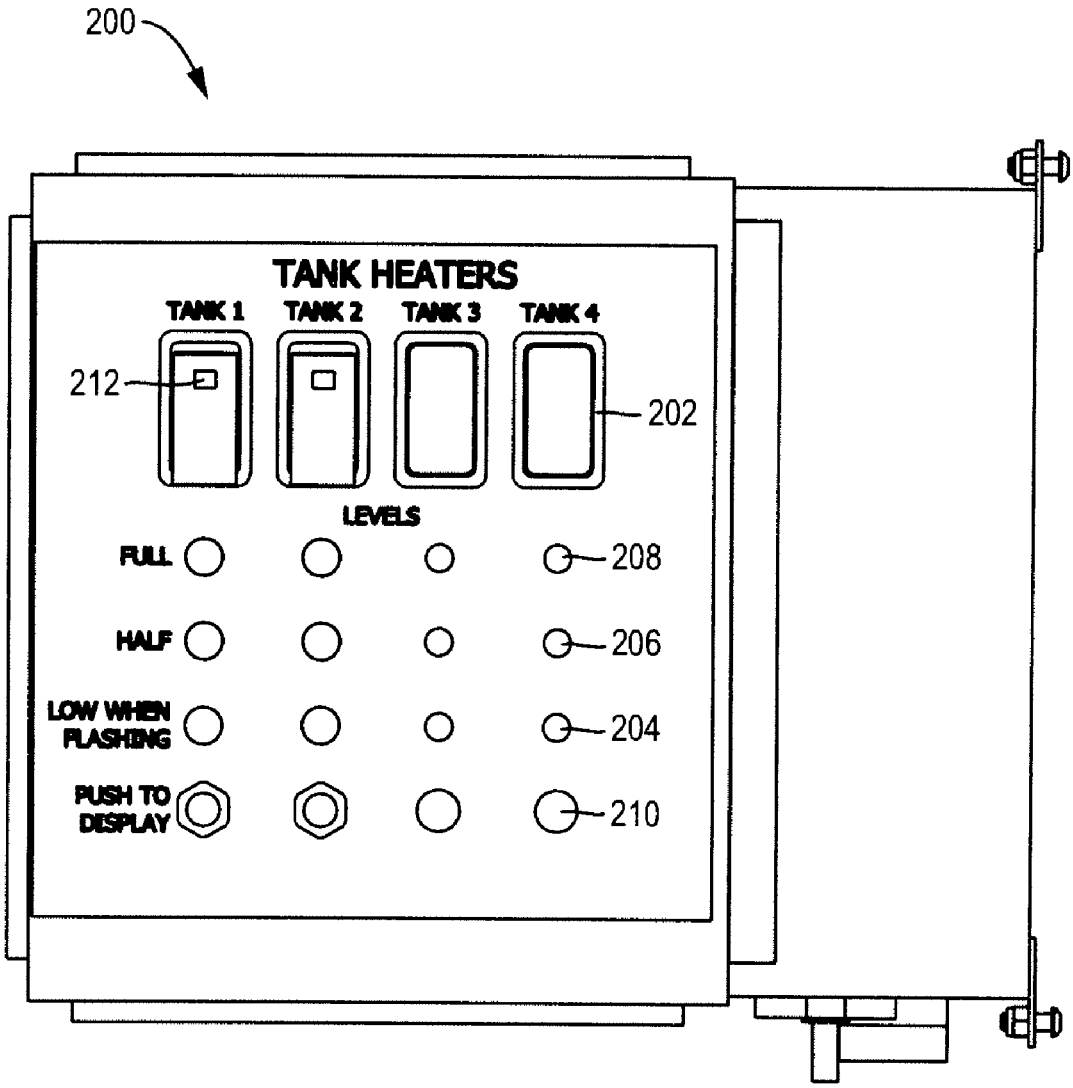
FIG. 3 is a front view of an exemplary control panel of the heating control system schematically illustrated in FIG. 2.

In accordance with the subject application, the heating control system 100 further includes a control panel (not shown in FIG. 2), on which the electrical power on/off switch 110, the low fluid level indicator 138, the medium fluid level indicator 148, and the high fluid level indicator 142 are placed. The control panel 200 is illustrated in FIG. 3 and will be described below with reference to FIG. 3.

In accordance with one aspect of the subject application, the control circuit 102 further includes a push button switch 152. The push button switch 152 is configured for selectively establishing an electrical connection between the electrical power source input port 108 and at least one of the following: the low fluid level indicator 138, the medium fluid level indicator 148, and the high fluid level indicator 142. The push button switch 152 is also placed on the control panel 200.

A heat indicator 154 is suitably included in the control circuit 102, being in electrical communication with the input coil 130 of the second relay 128. The heat indicator 154 is suitably placed on the control panel 200. In the embodiment illustrated in FIG. 2, the heat indicator 154 is combined with the electrical power on/off switch 110.

Also included in the control circuit 102 is a temperature sensor 156 configured for selectively terminating heating of a fluid contained in the fluid vessel. The temperature sensor 156 is coupled with the fluid contained within the fluid vessel 50. The temperature sensor 156 is further coupled with a fourth portion 158 of the control circuit 102. The fourth portion 158 of the control circuit 102 is configured to selectively disrupt an electrical connection of the input coil 130 of the second relay 128 with the first transfer output contact 120 of the first relay 116, responsive to a predetermined condition status of the temperature sensor 156.

Turning now to FIG. 3, there is shown a control panel 200 included in a control system 100 for controlling heating of fluids contained within four fluid vessels. As shown in FIG. 3, the control panel 200 included in a control system for controlling heating of fluids contained within four fluid vessels, is presented not as a limitation, but for illustration purposes only. It will be appreciated by a skilled artisan that the number of fluid vessels, in which heating of fluids is controlled suitably meets a user's needs may vary. In a system intended for use in various mobile applications, such as portable fluid delivery systems, the number of fluid vessels is defined, for example and without limitation, by the weight constraints for fluid vessels intended to be mounted on service utility vehicles, such that the weight constraints are to be fully met. A single fluid vessel is equally capable of being used in accordance with the present heating control system.

Thus, the control panel 200, as illustrated in FIG. 3, includes, corresponding to each of the four fluid vessels, an electrical power on/off switch 202, a low fluid level indicator 204, a medium fluid level indicator 206, and a high fluid level indicator 208. Also included in the control panel 200 is a push button switch 210 corresponding to each of the four fluid vessels. In a preferred embodiment, the control panel 200 also includes a heat indicator 212 combined with the electrical power on/off switch 202.

Referring now to operation of the heating control system 100, the operation of the heating control system 100 commences by switching the electrical power on/off switch 110 into an "on" position which is suitably a manual operation. Thus, the pair of normally open contacts 112, 114 of the on/off switch 110 are turned to a closed position enabling a suitable DC voltage from the electrical power source input port 108 to be applied to the control circuit 102. As illustrated in FIG. 2, the control circuit 102 corresponds to a condition status of the fluid vessel having a low level of fluid in it. The latter being the case, the first portion 126 of the control circuit 102 disrupts the electrical connection of the input coil 118 of the first relay 116 with the contact 114 of the electrical power on/off switch 110. Hence, the first relay 116 is not activated, and DC voltage is advantageously applied to the flasher relay 136 through closed contacts 124 and 122 of the first relay 116. As a skilled artisan will appreciate, through the flasher relay 136 DC voltage is also applied to the low fluid level indicator 138. A skilled artisan will also understand that at this point, as illustrated in FIG. 1, the condition status of the medium level fluid level sensor 146 is such that DC voltage is not applied to the medium level fluid level indicator 148. Accordingly, the condition status of the high level fluid level sensor 140 is such that DC voltage is not applied to the high level fluid level indicator 142.

Referring back to the first relay 116, the first relay 116 not being activated, DC voltage is not applied to the first transfer contact 122. This leads to the second relay 128 not being activated either, since DC voltage is not applied to the input coil 130 of the second relay 128. The second relay 128 keeps the condition of normally open output contacts 132, 134 to prevent activating the electrical power system 164 of a heating unit, and thus preventing heating of the fluid in the fluid vessel.

As fluid is introduced into the vessel, the level of the fluid becoming such that it corresponds to a medium fluid level condition status, or to a high fluid level condition status, the first portion 126 of the control circuit 102 establishes an electrical connection of the input coil 118 of the first relay 116 with the electrical power on/off switch 110. Hence, the first relay 116 is not activated, and DC voltage is advantageously applied to the flasher relay 136 through closed contacts 124 and 122 of the first relay 116. The flasher relay 136 DC voltage is also applied to the low fluid level indicator 138. A skilled artisan will also understand that at this point, as illustrated in FIG. 2, the condition status of the medium level fluid level sensor 146 is such that DC voltage is not applied to the medium level fluid level indicator 148. Accordingly, the condition status of the high level fluid level sensor 140 is such that DC voltage is not applied to the high level fluid level indicator 142.

Referring back to the first relay 116, the first relay 116 not being activated, DC voltage is not applied to the first transfer contact 122. This leads to the second relay 128 not being activated too, since DC voltage is not applied to the input coil 130 of the second relay 128. The second relay 128 keeps the condition of normally open output contacts 132, 134 to prevent activating the electrical power system 104 of a heating unit, and thus preventing heating of the fluid in the fluid vessel.

As fluid is introduced into the vessel, the level of the fluid becoming such that it corresponds to a medium fluid level condition status, or to a high fluid level condition status, the first portion 126 of the control circuit 102 establishes an electrical connection of the input coil 118 of the first relay 116 with the electrical power on/off switch 110. The first relay 116 is then activated leading to activation of the second relay 128. The output contacts 132, 134 turn to a closed position enabling activation of the electrical power system 104 of a heating unit. The heat indicator 154 is also activated at this point and indicates the process of heating. As the fluid level in a fluid vessel corresponds to a medium fluid level condition status, or to a high fluid level condition status, respective portions 150, 144 of the control circuit 102 establishing an electrical connection of the high fluid level indicator 148, 142, respectively, with the electrical power on/off switch 110. The respective indicators 148, 142 indicate a corresponding level of fluid in a fluid vessel.

In a preferred embodiment, as illustrated in FIG. 2, the push button switch 152 may advantageously be activated without activating the electrical power on/off switch 110. While the push button switch 152 is held in a "pushed" i.e., "on" position, DC voltage is applied in the same manner as when the electrical power on/off switch 110 is switched to an "on" position. This enables an express check of the level of fluid in the fluid vessel before the operation of the entire system is initialized.

In another preferred embodiment, as illustrated in FIG. 2, in a case when the temperature of the fluid in the fluid vessel becomes higher than a predetermined temperature, the fourth portion 158 of the control circuit 102 disrupts an electrical connection of the input coil 130 of the second relay 128 with the first transfer output contact 120 of the first relay 116. The latter leads to discontinuing heating of the fluid in a manner analogous to that of a low level of fluid in the fluid vessel.

Referring once again to FIG. 3, illustrated is an exemplary situation of four fluid vessels (not shown) with fluid levels corresponding to a high fluid level. Thus, the electrical power on/off switch 202 for each fluid vessel is in an "on" position, the medium fluid level indicator 206 and the high fluid level indicator 208 would be highlighted, for example, in a green color. The low fluid level indicator 204 would not be highlighted, or highlighted in a different color, for example and without limitation, in a red color. Since in a preferred embodiment, the heat indicator 212 is combined with the electrical power on/off switch 202, the electrical power on/off switch 202 is highlighted, when the heating unit is activated.

For purposes of this disclosure, the term "coupled" means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components or the two components and any additional member being attached to one another. Such joining may be permanent in nature or alternatively may be removable or releasable in nature.

Those skilled in the art will recognize that described herein implementations of the electrical power on/off switch 110, first and second relay 110, 128, as well as of other elements of the control circuit 102, are for illustration purposes only. Thus, a skilled artisan will understand that above described elements of the control circuit 102 are capable of being implemented as being selectively activated or deactivated responsive to a low fluid level in a corresponding fluid vessel such that heating of the fluid is terminated as the level of fluid becomes less than a predetermined value. All and any of these elements are capable of being implemented in any way known in the art.

The foregoing description of a preferred embodiment of the heating control system has been presented for purposes of illustration and description. It is not intended to be exhaustive or to limit the invention to the precise form disclosed. Obvious modifications or variations are possible in light of the above teachings. For example the heating control system can be coupled to one or more fluid vessels mounted on a work vehicle, such as a material hauler (cement or trash for example), a fire truck or a service truck. The embodiment was chosen and described to provide the best illustration of the principles of the heating control system and its practical application to thereby enable one of ordinary skill in the art to use the heating control system in various embodiments and with various modifications as are suited to the particular use contemplated. All such modifications and variations are within the scope of the appended claims when interpreted in accordance with the breadth to which they are fairly, legally and equitably entitled.

What is claimed is:

1. A heating control system for controlling heating of a fluid disposed in a fluid vessel comprising:

an electrical power input;

an electrical power on/off switch in electrical communication with the electrical power input;

a sensor responsive to a low fluid level in the fluid vessel, the sensor configured to be coupled with the fluid in the associated corresponding fluid vessel;

a first switch in electrical communication with the electrical power on/off switch and configured to be responsive to a predetermined condition status of the sensor responsive to the low fluid level in the associated corresponding fluid vessel; and a second switch in electrical communication with the first switch and configured to be responsive to a predetermined condition status of the first switch for selectively activating an electrical power system of a corresponding heating unit in thermal communication with the fluid vessel.

2. The heating control system of claim 1 wherein the sensor to a low fluid level in the associated corresponding fluid vessel is coupled with the fluid in the associated corresponding fluid vessel and configured to sense the low fluid level in the associated corresponding fluid vessel, and an indicator configured for indicating a low fluid level in the associated corresponding fluid vessel.

3. The heating control system of claim 2 further comprising a medium fluid level sensor in the fluid vessel, and a high fluid level sensor responsive to a high fluid level in the fluid vessel, with each sensor configured for sensing a corresponding fluid level in the associated fluid vessel, and an indicator configured for indicating the corresponding fluid level in the associated corresponding fluid vessel.

4. The heating control system of claim 3 further comprising a control panel, wherein each of the indicators of the low fluid level sensor, the medium fluid level sensor, and the high fluid level sensor in the corresponding fluid vessel, are disposed on the control panel.

5. The heating control system of claim 1 wherein the electrical power input is a DC electrical power source.

6. The heating control system of claim 1 wherein the electrical power system of the corresponding heating unit is an AC electrical power source.

7. A heating control system for controlling heating of a fluid disposed in an associated fluid vessel, the heating control system including a control circuit coupled with an electrical power system of a heating unit, and a low fluid level sensor coupled with the fluid in the associated fluid vessel, the control circuit comprising:

an electrical power source input port;

an electrical power on/off switch electrically connected with the electrical power source input port;

a first relay including an input coil selectively electrically connected with the electrical power on/off switch responsive to a predetermined condition status of the low fluid level sensor, and including a first transfer output contact, a second transfer output contact, and a common terminal; and a second relay including an input coil electrically connected with the first transfer output contact of the first relay, and including normally open output contacts electrically connected with an electrical power system of the heating unit;

wherein the common terminal of the first relay is electrically connected with the electrical power on/off switch.

8. The heating control system of claim 7 wherein the low fluid level sensor is further coupled with a first portion of the control circuit, wherein the first portion of the control circuit is configured to selectively establish an electrical connection of the input coil of the first relay with the electrical power on/off switch responsive to a predetermined condition status of the low fluid level sensor.

9. The heating control system of claim 7 further including a low fluid level indicator and a flasher relay configured for initializing flashing of the low fluid level indicator responsive to a predetermined condition status of the first relay, wherein the low fluid level indicator is electrically connected with the second transfer output contact of the first relay through the flasher relay.

10. The heating control system of claim 8 further including a high fluid level sensor, and a high fluid level indicator, wherein the high fluid level sensor is coupled with a second portion of the control circuit, and wherein the second portion of the control circuit is configured for selectively establishing an electrical connection of the high fluid level indicator with the electrical power on/off switch responsive to a predetermined condition status of the high fluid level sensor.

11. The heating control system of claim 10 further including a medium fluid level sensor, and a medium fluid level indicator, wherein the medium fluid level sensor is coupled with a third portion of the control circuit, and wherein the third portion of the control circuit is configured for selectively establishing an electrical connection of the medium fluid level indicator with the electrical power on/off switch responsive to a predetermined condition status of the medium fluid level sensor.

12. The heating control system of claim 11 further including a control panel, wherein the electrical power on/off switch, the low fluid level indicator, the medium fluid level indicator, and the high fluid level indicator are disposed on the control panel.

13. The heating control system of claim 12 further including a push button switch, wherein the push button switch is configured for selectively establishing an electrical connection between the electrical power source input port and at least one of the following: the low fluid level indicator, the medium fluid level indicator, and the high fluid level indicator, and wherein the push button switch is disposed on the control panel.

14. The heating control system of claim 7 further including a heat indicator, wherein the heat indicator is in electrical communication with the input coil of the second relay, and wherein the heat indicator is disposed on the control panel.

15. The heating control system of claim 14, wherein the heat indicator is combined with the electrical power on/off switch.

16. The heating control system of claim 7 wherein the electrical power source input port is coupled to a DC electrical power source.

17. The heating control system of claim 7 wherein the electrical power system of the heating unit is an AC electrical power source.

18. The heating control system of claim 7 wherein the electrical power on/off switch is configured to be manually operated.

19. The heating control system of claim 7 further including a temperature sensor configured for selectively terminating heating of the fluid contained in the fluid vessel, wherein the temperature sensor is coupled with the fluid contained in the fluid vessel.

20. The heating control system of claim 19, wherein the temperature sensor is further coupled to a fourth portion of the control circuit, wherein the fourth portion of the control circuit is configured to selectively disrupt an electrical connection of the input coil of the second relay with the first transfer output contact of the first relay, responsive to a predetermined condition status of the temperature sensor.

* * * * *